US009114287B2

(12) United States Patent
Anguiano

(10) Patent No.: US 9,114,287 B2
(45) Date of Patent: Aug. 25, 2015

(54) DISPLAY STAND FOR THE ORGANIZATION AND INFLATION OF BALLS AND THE LIKE

(71) Applicant: Cigarsolo, S.A DE C.V., Zapopan, Jalisco (MX)

(72) Inventor: Luis Medina Anguiano, Jalisco (MX)

(73) Assignee: CIGARSOLO, S.A. DE C.V., Zapopan, Jalizco (MX)

( * ) Notice: Subject to any disclaimer, the term of this patent is extended or adjusted under 35 U.S.C. 154(b) by 371 days.

(21) Appl. No.: 13/768,186

(22) Filed: Feb. 15, 2013

(65) Prior Publication Data

US 2014/0230964 A1 Aug. 21, 2014

(51) Int. Cl.
*A63B 41/12* (2006.01)
*A63B 47/00* (2006.01)

(52) U.S. Cl.
CPC ..... *A63B 41/12* (2013.01); *A63B 47/002* (2013.01); *A63B 2225/50* (2013.01)

(58) Field of Classification Search
CPC .... A63B 47/00; A63B 41/12; A63B 71/0036; A47F 5/02; A47F 1/04; A47F 2007/0092; A47F 7/00
USPC ..... 141/114, 313–317, 98, 391, 198, 369, 141/375; 211/85.7, 14–15, 163; 206/315.9; 224/919; 446/220
See application file for complete search history.

(56) References Cited

U.S. PATENT DOCUMENTS

| | | | | |
|---|---|---|---|---|
| 1,918,056 | A * | 7/1933 | Platt | 108/94 |
| 3,368,689 | A * | 2/1968 | Porterfield | 211/14 |
| 4,088,161 | A * | 5/1978 | Ikemoto | 141/167 |
| 5,988,433 | A * | 11/1999 | Crum | 221/309 |
| 6,158,593 | A * | 12/2000 | Olsen | 211/14 |
| 6,634,394 | B1 * | 10/2003 | Nelson et al. | 141/114 |

* cited by examiner

*Primary Examiner* — Timothy L Maust
*Assistant Examiner* — Timothy P Kelly
(74) *Attorney, Agent, or Firm* — Brooks Kushman P.C.

(57) ABSTRACT

The present utility patent consists of a hydraulic system which is intended for inflating deflated balls which are hanged, it has a hydraulic system to inflate balls and likewise deflating it, intended for commercial use in order customers purchase deflated balls and they may inflate and deflate them in the same exhibitor module.

16 Claims, 8 Drawing Sheets

DISPLAY STAND FOR THE ORGANIZATION AND INFLATION OF BALLS AND THE LIKE

INVENTION PURPOSE

Figure 1:
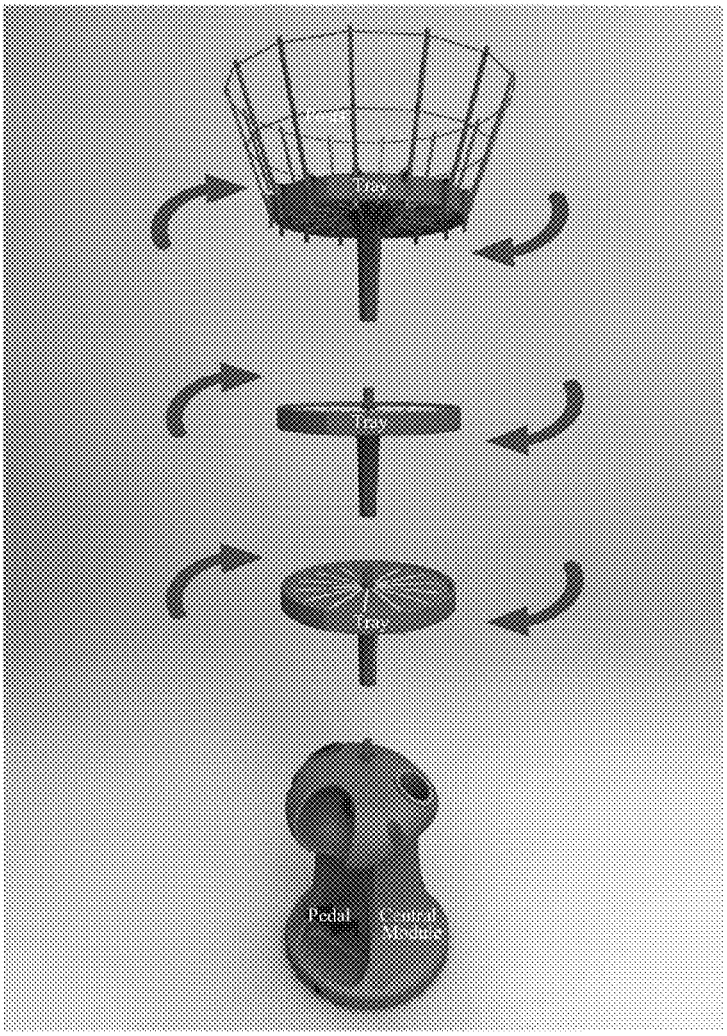

The present application of Utility Patent intends to register a Hydraulic System, that has as purpose to inflate balls and also deflate the same, intended for commercial use in order customers purchase the deflated balls and they may inflate and deflate them in the same exhibitor module.

INVENTION BACKGROUND

In the current market are well known the different ways of commercializing and transporting the inflatable ball and the problems this represents in points of sale.

In general, the inflatable balls are sold in containers and/or meshes where these are displayed already inflated. And in the most of cases for the end consumer is difficult to get the desired ball because it can be difficult to remove it from the container due to the large number of inflated balls that are in it.

Particularly, when the ball is going to be transported to the point of sale, this should be transported without air, and to be inflated in the point of sale, so that costs are incurred in the points of sale.

Likewise, when balls are inflated, generally children play with them and balls end dirty and sometimes perforated, and balls providers has to clean them up and change the damaged balls, so that there are extra costs.

Also it is obtained an advantage by having the possibility of deflating the ball by means of valve that allows deflating the ball to be kept and easily transported for being subsequently used again.

Also the space occupied by the balls already inflated many times is unprofitable for points of sale, reason for which, shops selling inflatable balls are limited.

This system may be implemented in a reduced space due to the manner in which this is designed.

The hydraulic system, subject matter of the present registration, solves the above mentioned inconveniences, contributing also other additional advantages that will be evident from the description next detailed.

Particularly, the exhibitor module of deflated and hanged balls with the inflating hydraulic system of the invention is designed for commercial use, to use a surface of 60 cm×60 cm and which stores up to 196 deflated balls, reason for which maximizes the profitability because of the space occupied in the point of sale.

Specially, the exhibitor module of deflated and hanged balls with inflating hydraulic system, avoids all kind of cost that may be generated in the points of sale of balls.

Another advantage and from the innovation, is that in addition this make possible the power of selling inflated balls in air, maritime and train ports, as well as bus station, due to as above mentioned, the ball may be deflated without any restriction.

INVENTION DESCRIPTION

For this, said system includes the following parts:

A) TRAYS.—These are rotating and have the functional qualities for hanging the deflated balls and may be used in a modular manner. Likewise it has the functional quality that in the same tray by installing posts, this may be used to exhibit inflated balls. Trays have guides, which are placed in a descendent manner in order the hanged balls slide by means of the gravity toward the edge of the tray and so that the tray always is full of balls although there are few balls.

B) THE CENTRAL MODULE.—Consists of a roto-molded structure, which contains all the components of the exhibitor module, consisting of inflating needle, hydraulic pump, pumping system, deflating needle, as well as the internal tube which works as axis for the tray.

C) INFLATING NEEDLE.—This is made of steel with a diameter of 4 mm, Teflon coated, this is unbreakable, does not perforate balls and has the functional quality of introducing air inside the balls.

D) DEFLATING NEEDLE.—It has the functional quality of deflating the ball to make possible the client may deflate it and transport the same without any problem to be subsequently inflated again.

E) HYDRAULIC SYSTEM.—Used to move water which performs the function of a piston and displaces air which leaves the system and inflates the ball. A significant aspect is that depending on the water level within the system is achieved the maximum pressure regulation of inflation of the ball, avoiding the ball explode because of the over inflated, this is achieved due to the internal pressure of the ball is matched with the internal pressure of the hydraulic system, the above mentioned system has two one-way check valves, the first of them allows to leave the air toward the needle and the ball, but it does not allows the return of air; the second one allows the recovery of air in the system.

F) SYSTEM OF WIRELESS REMOTE CONTROL.—This has as function to close the hydraulic system at the moment the sale is closed and so that to allow the customer inflates the ball. Other of the novelties is that the wireless remote control may be used.

G) HANGING SYSTEM.—This has as function to hold the deflated ball in order this may be hanged.

H) BACK VALVE. This is developed according to needle diameter.

I) Additionally, the hydraulic system includes an inflatable element, such as balloon, balls or the like, which is placed deflated, HANGED from the space defined. The air inlet is carried out by means of the hydraulic system using water which by displacing it carries out the function and moves the air which leaves from the system and inflates the ball by means of an inflating needle that by combination of their functions above mentioned and hydraulic system avoid that ball explode due to an over inflation. By means of the check valve, which avoids the return of air to the inflatable element, while the air outlet consists of an outlet which is placed at the center with respect to the deflating needle.

The above mentioned air outlet has fastening means for coupling the check valve.

According to other invention characteristic, the system or hydraulic pump that carries out the operation of displacing air to inflate the ball, does it through the water in the container of the machine, which is next presented in figures of the present utility patent.

J) CONTAINERS.—These are located in the upper part of the central module and has the purpose of depositing the recyclable materials, that is to say, these deposit the waste, such as label and fastening system of inflatable elements for a future recycling.

Advantageously, thanks to the characteristics of the invention described, it is obtained a novel hydraulic system for inflating and deflating balloons, balls and the like. To complete de description which is next mentioned in order to help for a better understanding of its components and novelty of the same in an illustrative manner but not limited are represented the more important details of the invention.

DESCRIPTION OF DESIGNS

FIG. 1. It shows a separately view of each one of the components integrating the Hydraulic System.

Figure 2:
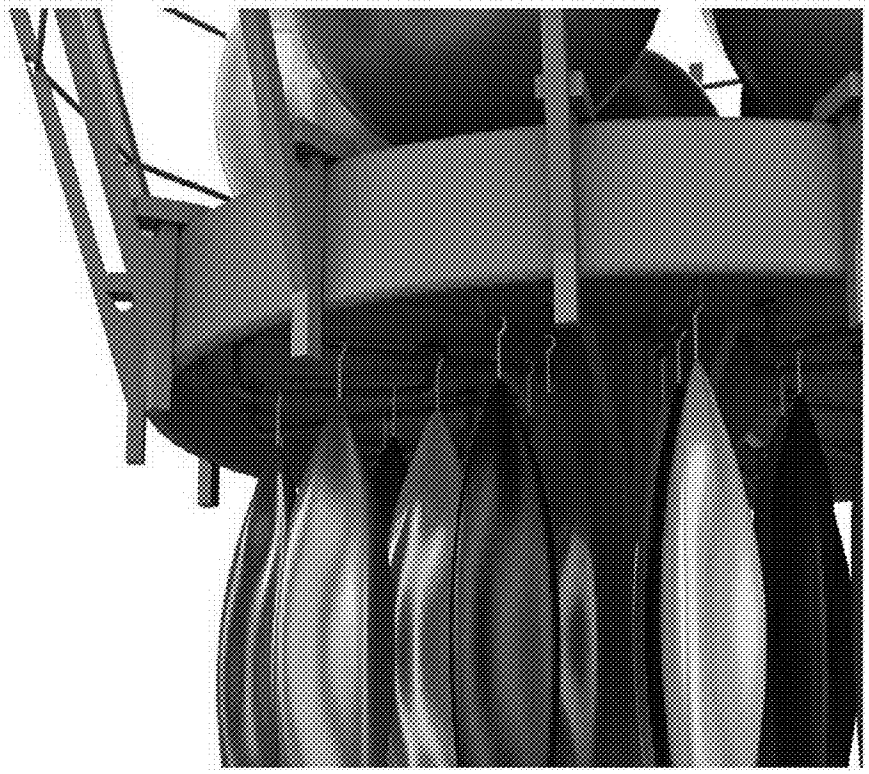

FIG. 2.—It shows a view where deflated ball appears as such and holding by the hook, support and tag pin integrating the Hydraulic System.

Figure 3:
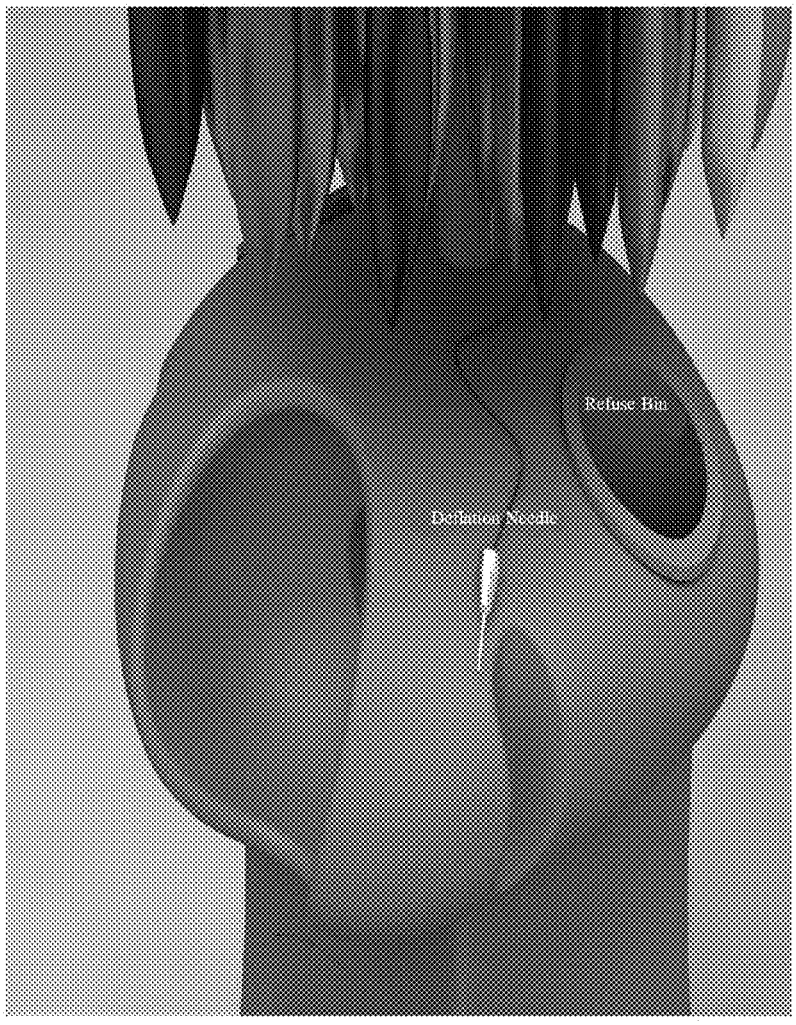

FIG. 3.—View of the component of deflating needle, also from the recycle center to deposit the waste generated because of the use of the inflatable element that integrates the hydraulic system.

Figure 4:
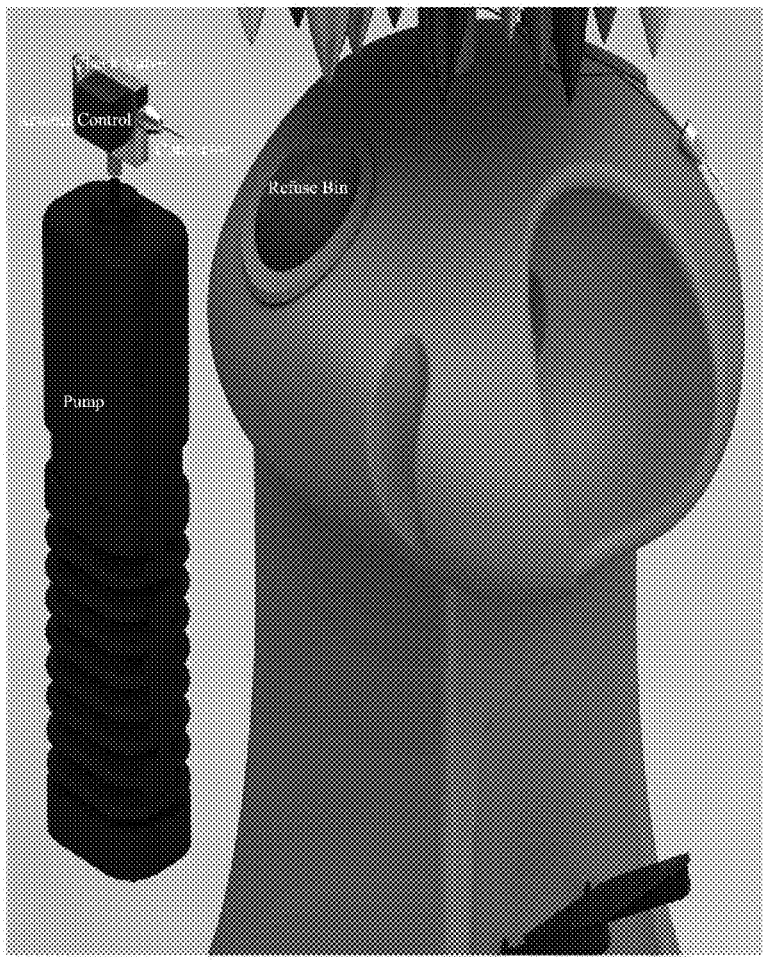

FIG. 4.—View of the remote control component of the hydraulic pump that integrates the hydraulic system.

Figure 5:
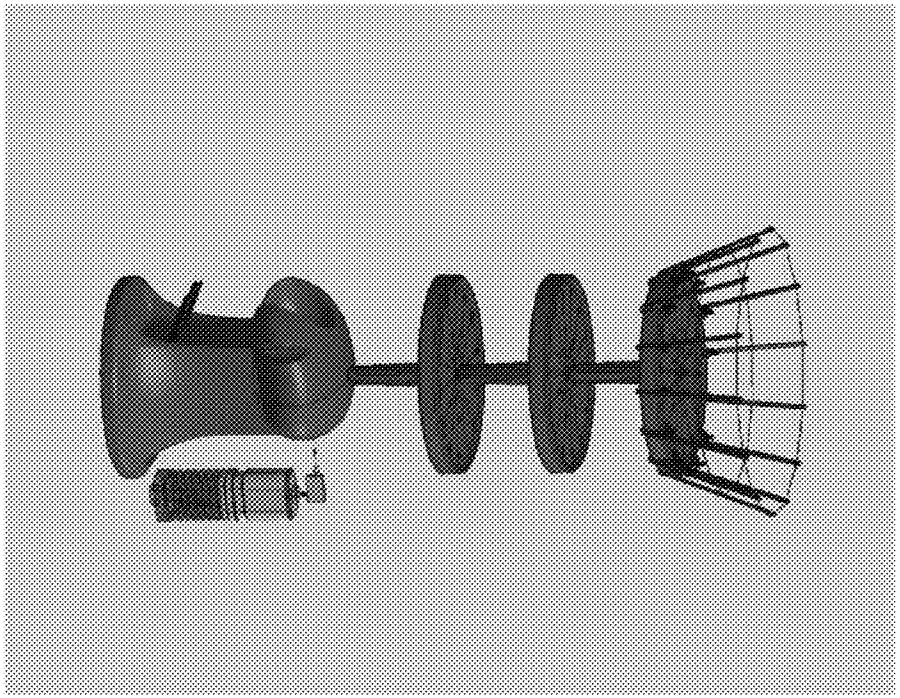

FIG. 5.—Lateral view of the hydraulic system machine.

Figure 6:
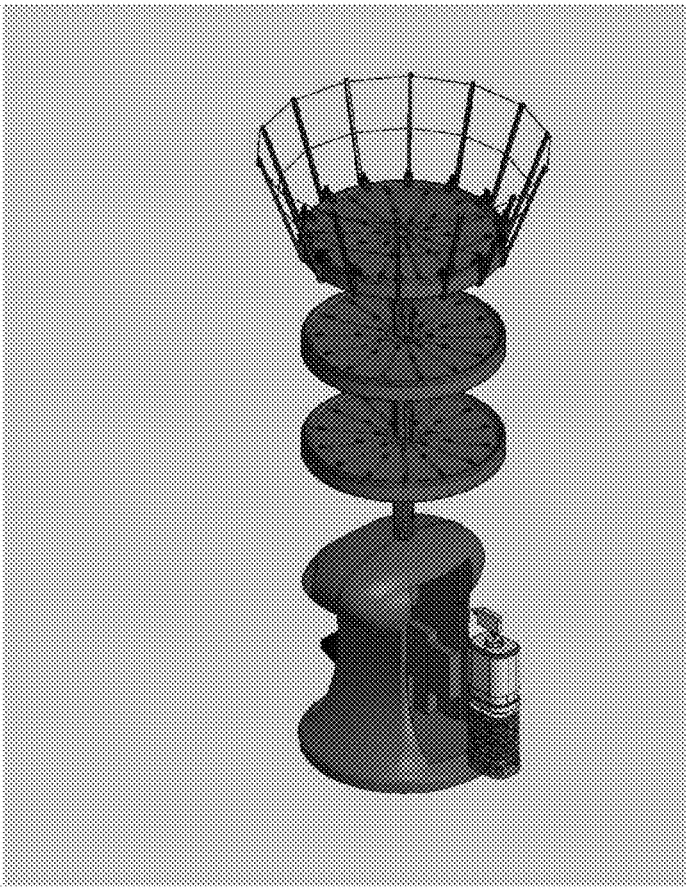

FIG. 6.—View in perspective of the hydraulic system machine.

Figure 7:
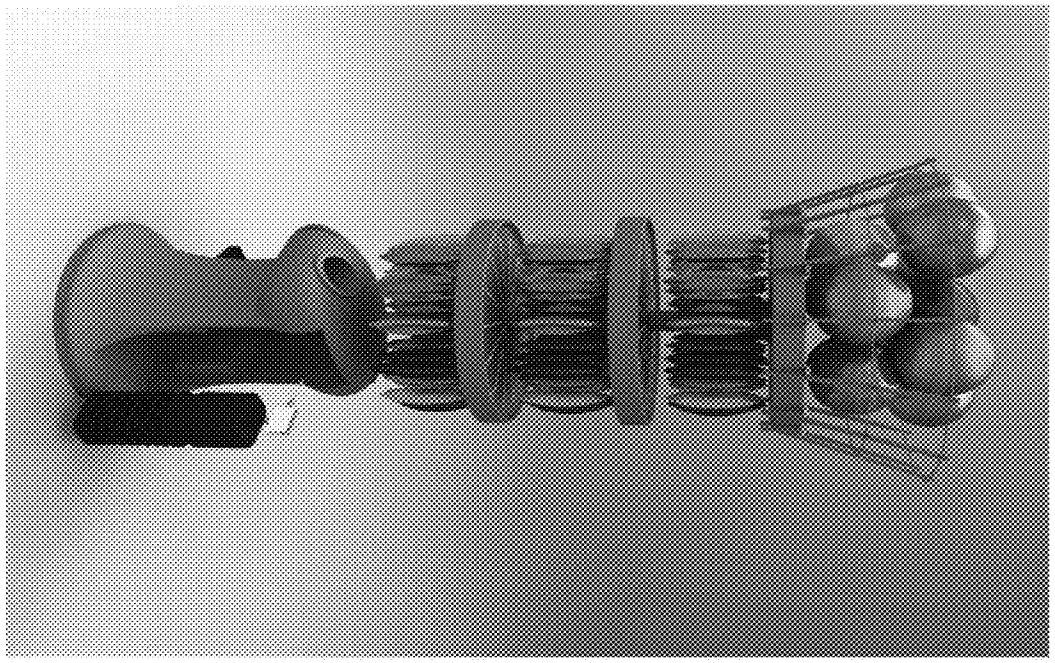

FIG. 7.—Rear view where it is showing the container that contains the water for the operation of the machine with hydraulic system.

Figure 8:
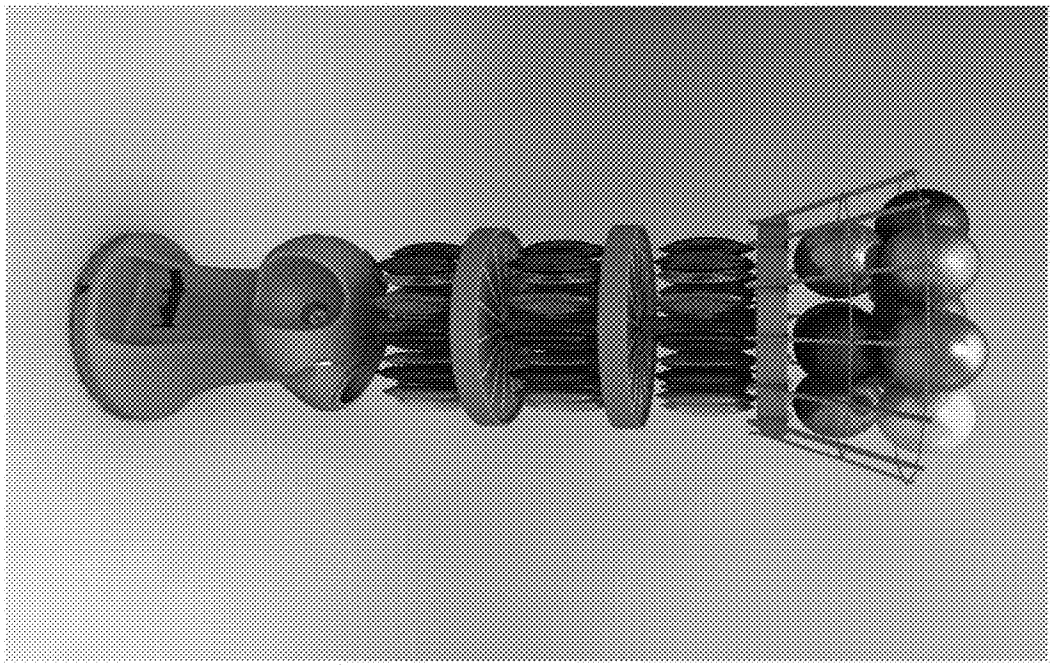

FIG. 8.—It shows a general view of the Hydraulic System Machine.

Details, forms, dimensions and other accessory elements, as well as materials used in manufacturing the hydraulic system of the invention may be conveniently replaced by others technically equivalent and which neither apart from the essentiality of the invention nor scope defined by claims next specified:

The invention claimed is:

1. A display stand configured to organize balls for selection and to inflate a selected ball, comprising:

a central module having a housing with a bottom surface configured to form a base of the display stand, the housing having a top surface;

a pump locatable within the housing and configured to provide a predetermined amount of air to facilitate inflation of the selected ball while reducing the possibility of over inflation thereof;

a connector configured to allow engagement between the selected ball and the pump; and an exhibitor module disposed on the top surface of the central module, the exhibitor module comprising a first tray spaced apart from the central module, wherein the first tray is configured to allow uninflated balls to be hung therefrom.

2. The display stand of claim 1, wherein the exhibitor module is configured for rotation about an axis that is generally perpendicular to the bottom surface of the central module, wherein the uninflated balls can be rotated to facilitate viewing by rotating the first tray prior to selection of one of the uninflated balls for inflation by the pump.

3. The display stand of claim 2, wherein the exhibitor module further comprises a second tray disposed a side of the first tray opposite from the central module, the second tray being configured for rotation about the axis, wherein the second tray is configured to allow uninflated balls to be hung therefrom to create a second level of hanging uninflated balls positioned above the central module.

4. The display stand of claim 3, wherein the exhibitor module further comprises a third tray disposed a side of the second tray opposite from the first tray, the third tray being configured for rotation about the axis, wherein the third tray is configured to allow uninflated balls to be hung therefrom to create a third level of hanging uninflated balls positioned above the central module.

5. The display stand of claim 4, wherein any one of the first tray, the second tray, and the third tray may further comprise posts thereon to allow inflated balls to be securely positioned thereon.

6. The display stand of claim 5, wherein any one of the first tray, the second tray, and the third tray may further comprise guides that slope generally downwardly toward the central module and generally outwardly from the axis, the guides being configured to bias hanging deflated balls to slide toward a periphery of the tray.

7. The display stand of claim 1, wherein the exhibitor module is configured for rotation about an axis that is generally perpendicular to the bottom surface of the central module, wherein the uninflated balls can be rotated to facilitate viewing by rotating the first tray prior to selection of one of the uninflated balls for inflation by the pump, a cylindrical rod connects the first tray to the central module while allowing for rotation therebetween.

8. The display stand of claim 1, wherein the central module is formed via rotational molding.

9. The display stand of claim 6, wherein the central module further comprises a deflation needle which is tethered thereto, the housing of the central module defining a deflation needle groove configured to detachably receive the deflation needle therein.

10. The display stand of claim 9, wherein the housing further defines a plurality of opposed recesses configured to hold refuse.

11. The display stand of claim 10, wherein the central module further comprises a pedal configured to activate the pump to inflate the selected ball.

12. The display stand of claim 1, further comprising a wireless remote control in communication with a controller located in the central module and configured to activate the pump to inflate the selected ball.

13. The display stand of claim 12, wherein the wireless remote control is configured to selectively deactivate the pump to prevent inflation.

14. The display stand of claim 10, wherein the housing of the central module further defines a concave depression configured to inflate the selected ball when positioned therein via the connector.

15. The display stand of claim 14, wherein a surface of the concave depression further defines a bore within which the connector is positioned for engagement with a deflated ball.

16. The display stand of claim 15, wherein the connector comprises an inflation needle and the pump includes a check valve to prevent deflation via the connector after air is inserted into the selected ball.

* * * * *